United States Patent [19]

Klima

[11] 4,453,836

[45] Jun. 12, 1984

[54] SEALED HARD-ROCK DRILL BIT

[76] Inventor: Frank J. Klima, 1401 W. Chestnut St., Virginia, Minn. 55792

[21] Appl. No.: 297,944

[22] Filed: Aug. 31, 1981

[51] Int. Cl.[3] ..... F16C 33/76; E21B 10/22; E21B 10/24

[52] U.S. Cl. ..... 384/94; 384/93; 175/371

[58] Field of Search ..... 175/371, 372; 308/8.2, 308/187.1, 187, 187.2, 36.1, 36.2, 36.3; 277/216

[56] References Cited

U.S. PATENT DOCUMENTS

| | | | |
|---|---|---|---|
| 2,126,035 | 8/1938 | Reed | 175/375 |
| 2,126,040 | 8/1938 | Reed | 308/8.2 |
| 2,177,333 | 10/1939 | Reed | 308/8.2 |
| 2,664,322 | 12/1953 | Boice | 308/8.2 |
| 2,673,128 | 3/1954 | Reed | 308/8.2 |
| 2,690,935 | 10/1954 | Alexander | 308/8.2 |
| 2,719,026 | 9/1955 | Boice | 175/375 |
| 3,193,028 | 7/1965 | Radzimovsky | 308/8.2 |
| 3,251,634 | 5/1966 | Dareing | 308/8.2 |
| 3,344,870 | 10/1967 | Morris | 175/374 |
| 3,461,983 | 8/1969 | Hudson et al. | 175/375 |
| 3,572,452 | 3/1971 | Winberg | 308/8.2 |
| 3,628,616 | 12/1971 | Neilson | 175/410 |
| 3,866,695 | 2/1975 | Jackson | 308/8.2 |
| 3,921,735 | 11/1975 | Dysart | 308/8.2 |
| 3,952,815 | 4/1976 | Dysart | 175/374 |
| 4,013,325 | 3/1977 | Rear | 308/4 A |
| 4,102,419 | 7/1978 | Klima | 175/371 |
| 4,140,189 | 2/1979 | Garner | 175/374 |
| 4,183,417 | 1/1980 | Levefelt | 308/8.2 |
| 4,284,310 | 8/1981 | Olschewski et al. | 308/8.2 |

*Primary Examiner*—Stuart S. Levy
*Assistant Examiner*—Thomas R. Hannon
*Attorney, Agent, or Firm*—Peterson, Palmatier, Sturm, Sjoquist & Baker, Ltd.

[57] ABSTRACT

A sealed, internally lubricated rotary roller drill bit for drilling hard earth formations in which internally disposed axially, thrust and ball anti-friction bearings are used in combination and in which a first seal means is provided for preventing the introduction of drilling debris and a second seal means is provided to prevent the introduction of such debris and to maintain the lubricant inside of the bit under pressure. A pressure relief means is provided to allow excess lubricant to flow around one of the seals. A stream of air is directed through the bit, first in a direction to "clean" the bore hole and in further directions to allow ready access to a lubricant fitting and to effect a seal at the interface between rotating portions of the bit.

6 Claims, 3 Drawing Figures

22
12
25
47
46
23
45
13
30
44
31
27
43
20
21
15
54
42
40
41
53
19
52
18
33
51
50
29
17
28
16

SEALED HARD-ROCK DRILL BIT

BACKGROUND OF THE INVENTION

1. Field of the Invention

This invention relates generally to drill bits for providing holes in earth formations for wells, blast holes and the like. It is more particularly directed to rotary drill bits for use in relatively hard earth formations which may also be abrasive in nature, such as taconite or the like. One of the problems associated with drill bits of the class of drilling activities in which my invention finds substantial advantageous use, is concerned with economics, not only in the cost of labor for running drilling equipment, but in the cost of the drilling equipment itself, including the expendable drilling bits. My invention provides an improved economic advantage, when considering the factors set forth above, and others, in that it provides a substantially longer life, may be easier to fabricate of available components and is reliable in operation.

2. Description of the Prior Art

The following is a list of prior art patents noted in the course of an investigation concerning the subject matter of this application;

| U.S. Pat. No. | Inventor | Date of Issue |
|---|---|---|
| 3,193,028 | Radzimovsky | 7/6/65 |
| 3,251,634 | Dareing | 5/17/66 |
| 3,344,870 | Morris | 10/3/67 |
| 3,461,983 | Hudson et al | 8/19/69 |
| 3,572,452 | Winberg | 3/30/71 |
| 3,628,616 | Neilson | 12/21/71 |
| 3,866,695 | Jackson | 2/18/75 |
| 3,921,735 | Dysart | 11/25/75 |
| 3,952,815 | Dysart | 4/27/76 |
| 2,126,035 | Reed | 8/9/38 |
| 2,126,040 | Reed | 8/9/38 |
| 2,177,333 | Reed | 10/24/39 |
| 2,673,128 | Reed | 3/23/54 |
| 2,664,322 | Boice | 12/29/53 |
| 2,690,935 | Alexander | 10/5/54 |
| 2,719,026 | Boice | 9/27/55 |
| 4,013,325 | Rear | 3/22/77 |
| 4,140,189 | Garner | 2/20/79 |
| 4,183,417 | Levefelt | 1/15/80 |

While the above prior art is set forth to disclose the information available to the inventor as a result of a preliminary investigation, it is not believed that any one of the patents listed is more relevant than any of the others and therefore no other comments are believed necessary.

DETAILED DESCRIPTION OF THE ILLUSTRATED EMBODIMENTS

Figure 1:
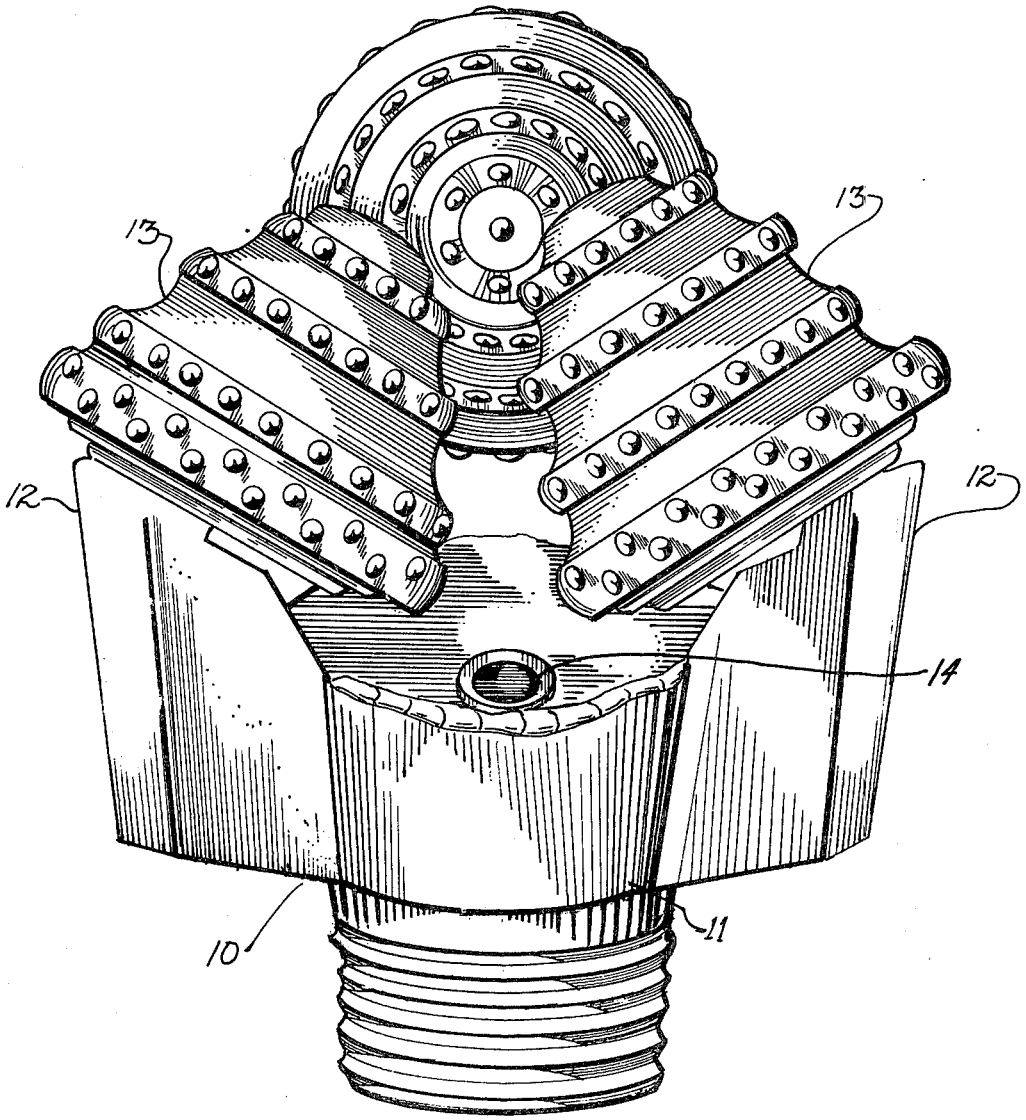
FIG. 1 is a perspective sketch of a rotary drill bit of the invention.

Referring to the drawings, a rotary drill bit of the class to which my invention pertains, is indicated generally by reference character 10 and includes a body portion 11, having a top threaded portion for threaded connection to a drill string pipe. Body 11 is comprised of a plurality of legs 12 that may conveniently be fabricated in sections and then joined together, as by welding, to form body 11, and a like plurality of rotary cone shaped cutters 13 rotatably disposed on journals 15 at the lower inner ends of legs 12.

Legs 12, because of their orientation in an assembled bit, may be thought of as having a top outer end and a journal 15 at the lower inner end in the sense that the lower journal end is directed inwardly of the periphery of the body 11 of a drill bit 10. The lower, or inner end of journals 15 is indicated by reference character 16 and it may be seen that the axis of inner end of journals 15 is preferably disposed, when assembled into a body 11, at an angle of 36° to 45° with respect to a horizontal plane that is perpendicular to the vertical axis of body 11 and thereby to a drill stem to which drill bit 10 may be connected. Proceeding upwardly and outwardly from inner end 16 on journals 15, there is shown an axially extending roller bearing race groove 17, a roller bearing race surface 33, extending radially of the axis of inner end 16, a ball bearing retainer race groove 18, having a radius related to the radius of ball bearings to be positioned therein, an axially extending roller bearing race surface 19, a first seal groove 20 and a second seal groove 21. It may be noted that journals 15 are circular in cross-section and symmetrical about the center axis shown. Legs 12 are also provided with an air duct 22 that extends from the top outer portion of body 11, for receiving air from inside of the drill stem through the top threaded portion of body 11, to the side skirt portions on legs 12. Air duct 22 is also shown connected to a branch air duct 23. Legs 12 are also shown provided with an outer stabilizer portion 25 that may be further provided with carbide inserts 26 and includes a downwardly extending skirt portion 27.

A lubrication duct 28 extends inwardly through journals 15 to the lower inner end and is provided with a lubrication fitting 29 appropriate for a suitable lubricant to be introduced into a completed drill bit 10. A lubrication relief duct 30 is shown extending from the inner end of journals 15 to seal groove 21. A pressure relief valve 31 is shown disposed at an appropriate location in relief duct 30.

Cones 13 are provided with an interior recess indicated generally by reference character 40. Recess 40 is shown having an inner end 41, an axially extending roller bearing race surface 42, a radially extending roller bearing race surface 43, a ball bearing retainer race-groove 44, an axially extending roller race groove 45, an axially extending seal surface 46 and a radially extending outwardly opening air groove 47 adjacent the top or outer end of recess 40.

Figure 2:
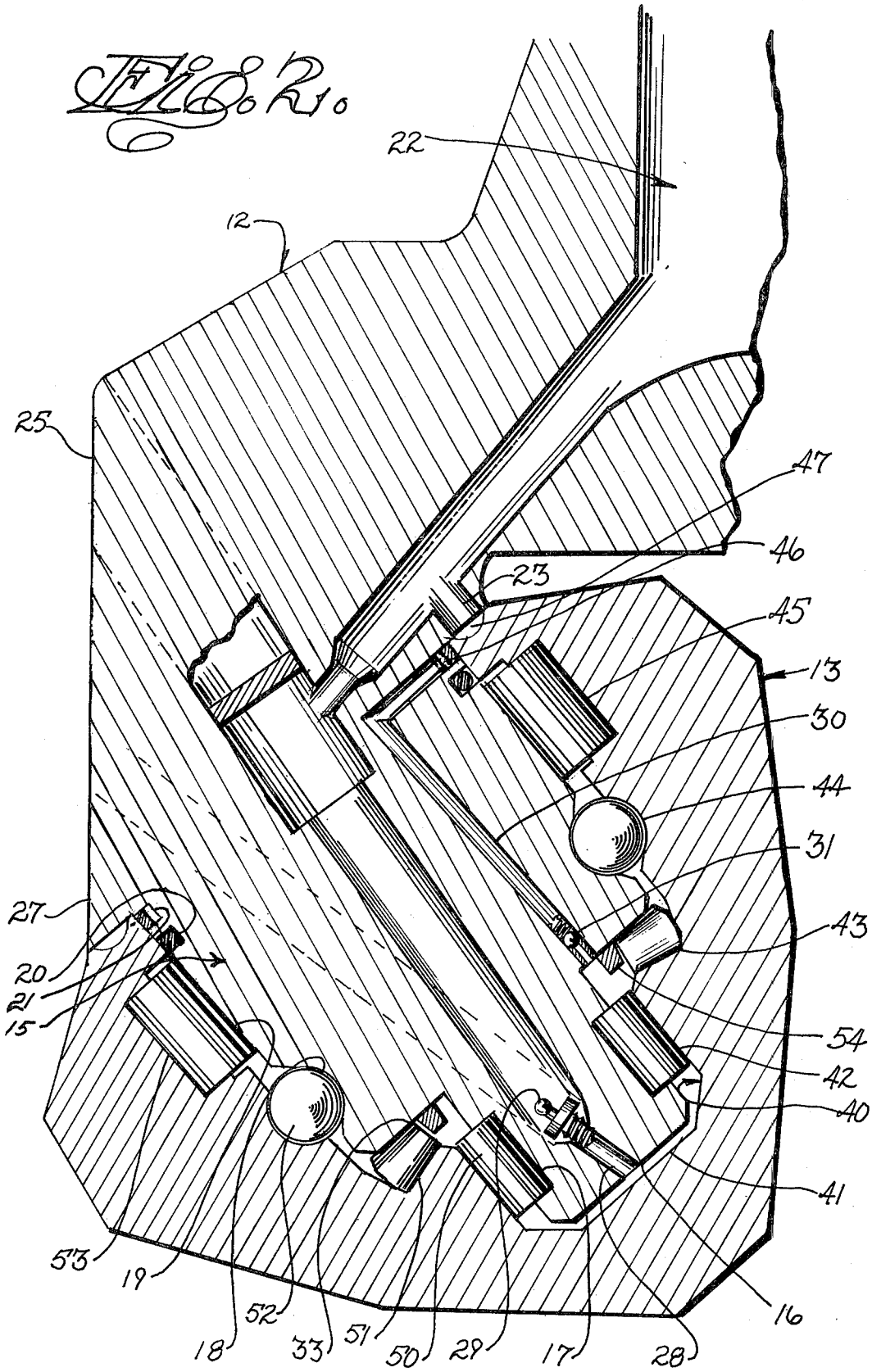
FIG. 2 is an enlarged fragmentary view of a portion of the illustration of FIG. 1, partly in section, showing a first embodiment of my invention.

A plurality of anti-friction roller and ball bearings are disposed intermediate the complementary configured and disposed bearing grooves and surfaces described above in connection with journals 15 and cones 13 and include a plurality of axial roller bearing members 50, a plurality of radially disposed thrust roller bearing members 51, a plurality of retainer-ball bearing members 52 and a plurality of roller bearing members 53. Thrust roller bearings 51 of FIG. 2 are shown having a tapered configuration and it may be noted that a floating spacer ring 54 is disposed at the radially inward periphery of the rollers and that the radially outward ends of rollers 51 are provided with a convex configuration.

The seals to be placed in grooves 20 and 21 are indicated as seal 60 which may be described as an inner seal and which is preferably comprised of an elastomer resilient material that is slightly compressed when in the assembled position shown so that its outer peripheral surface is in sliding frictional and sealing engagement with surface 46 on cones 13 and the inner portions provide a sealing non-rotating contact with the bottom and sides of seal groove 20 in journals 15. The outer seal is indicated generally by reference character 64 and is preferably comprised of a continuous metallic ring of material that is in non-sliding engagement with seal surface 46 on cones 13 and is in sliding frictional engagement with the sides of seal groove 21 in journals 15. It may thus be observed and understood that seal 60 provides a form of pressure responsive seal while seal 64 provides a labyrinth type of seal. The combination of seals 60 and 64 serves to prevent the escape of lubricant from the inside of cones 13 and the inner ends of journals 15 while providing an adequate barrier to prevent the entry of any foreign material, such as drilling debris, into the lubricant containing portions of journals 15 and cones 13.

Figure 3:
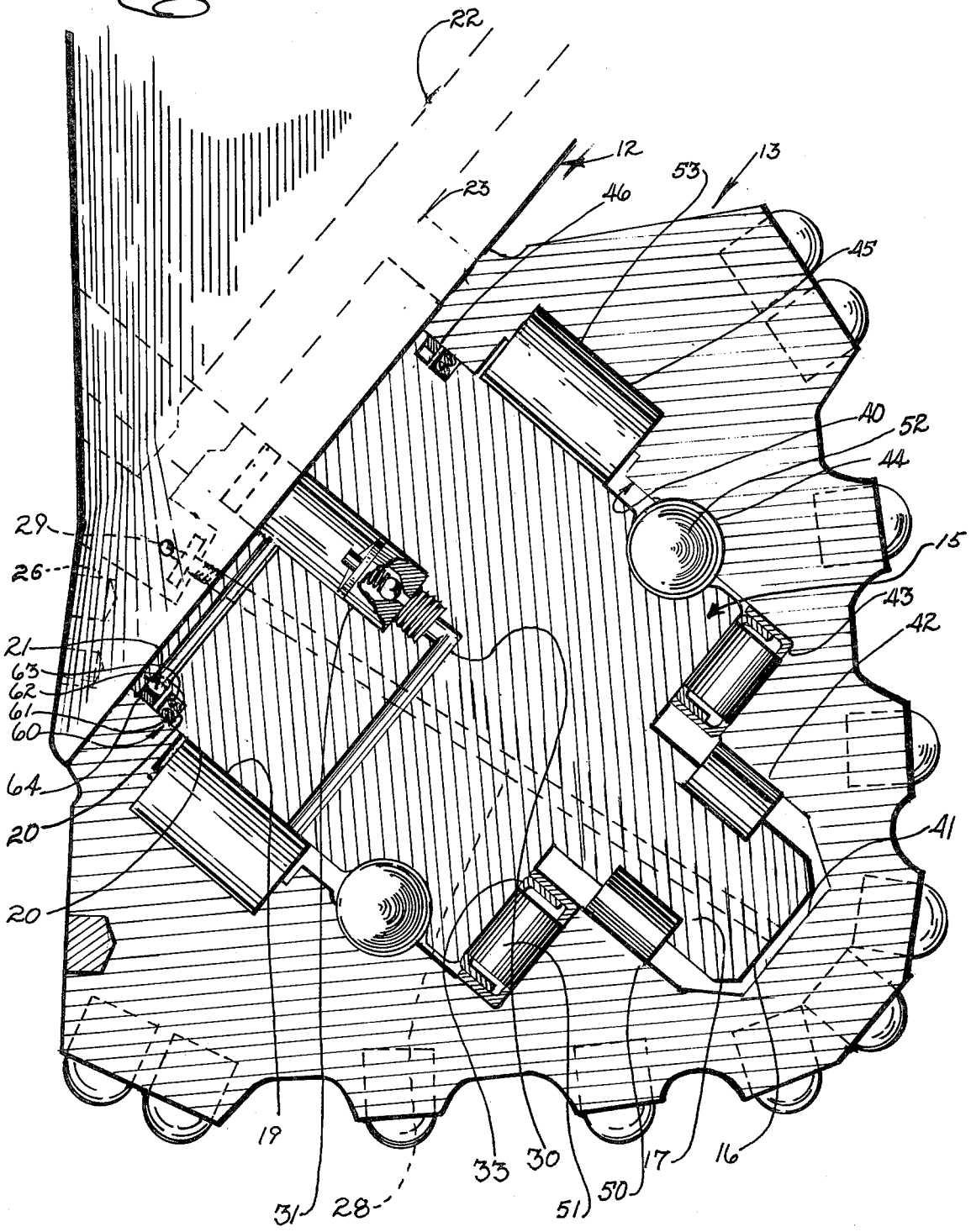
FIG. 3 is a similarly enlarged, fragmentary view, partly in section, of a portion of FIG. 1 showing a second embodiment of my invention.

FIG. 3 illustrates a further embodiment of my invention in which inner seal 60 is shown comprised of a large O-ring 61 that extends outwardly of inner groove 20 and a pair of smaller O-rings 62 and 63 that are disposed adjacent the bottom sides of groove 20. O-rings 62 and 63 may be of lesser hardness with respect to O-ring 61. FIG. 3 further indicates a relocation of lubricant fitting 29 for adding lubricant to the inside of cones 13, as may be required.

It may be noted that the radius of ball-retainer race groove 18 in journals 15 may be related to the radius of retainer-ball bearings 52 whereby the radius of groove 18 is 0.52 times the radius of retainer-balls 52.

The combination and sub-combinations of elements set forth above provide an improved drill bit of the anti-friction bearing type in which the individual elements may be dimensioned to closer tolerances to thereby allow the use of larger carbide, or the like, cutting elements on cones 13 as well at to provide a vastly increased life and economic advantage.

OPERATION OF THE ILLUSTRATED EMBODIMENTS

With the above elements in mind, and assuming that legs 12, having cones 13 in operative disposition, have been assembled to form a body 11, a drill bit 10 is assembled to the end of a drill string. Lubrication is applied to lubricant fitting 29 disposed in air duct 22, extending through the side of legs 12, and is supplied to the interior of cones 13 around journals 15 until the pressure relief valve allows lubricant to flow through duct 30 and seal groove 21 and to appear at the outer periphery of recess 40 in cones 13 adjacent legs 12. The appropriate drive mechanism for the rotary drill stem is started and air is supplied through the interior of the drill stem to air ducts 22 in journals 12. Part of the air flows through duct 22, over lubricant fitting 29, and outwardly through the outer periphery of legs 12 and through branch 23 to radial air groove 47 in cones 13 and therefrom radially outwardly through the interface between legs 12 and the outer surface of cones 13 the rest flows through jet nozzles. As downward pressure is applied to the drill stem, drill bit 10 comes into contact with the earth's formation and commences to drill by rolling cones 13 over the substances encountered. The work performed in breaking up the earth, rock and the like, generates a substantial amount of heat and causes the lubricant on the interior of cones 13 to expand and thereby increase its pressure. It may be appreciated that part of the heat generated is carried out and emitted laterally of legs 12 as the air under pressure circulates through the ducts and nozzles in body 11.

As the temperature of the grease increases, the pressure within cones 13 increases to a level, determined by the characteristics of relief valves 31 in relief duct 30 in journals 15. When the predetermined pressure is exceeded, lubricant is allowed to escape and is conducted outwardly through duct 30 to the bottom of seal groove 21 in journals 15. This provides a lubrication function for outer seal 64 as well as to prevent the application of undue destructive pressure forces to inner seal 60.

The air under pressure supplied to the interface between the outer end of cones 13 or radial air groove 47 in cones 13 is allowed to expand radially outwardly between journals 15 and the outer end of cones 13 to inhibit the flow of drilling debris into cones 13.

It may also be noted that the tapered thrust roller bearings 51 illustrated in FIG. 2 will provide a "trueline" rolling contact that may contribute further to the longevity of the drill bit under working conditions. Similarly, the larger radius of ball bearing retainer race groove 18 over the size of retainer ball bearings 52 provides a further longevity of effective life of drill bit 10.

When it becomes necessary to supply additional lubricant to the interior of cones 13, it may be appreciated that the flow of the cooling and cleaning air through air duct 22, over lubricant fitting 29, prevents the accumulation of drilling debris so as to allow ready access to the fitting.

I claim:

1. In a lubricated rotary drill bit, comprising in combination;

a plurality of vertically disposed leg members, each of said leg members having a downwardly depending, circular, cutter receiving journal, said journal having a cylindrical outer end of reduced diameter and including a radially extending roller bearing surface and a ball bearing receiving groove adjacent said surface;

a like plurality of circular cutter means, each of said cutter means having an outer cutting surface and including a recess of complementary configuration rotatably disposed on said journals, said recess including a complementary disposed radially extending roller bearing surface intermediate the inner and outer ends, a ball bearing receiving groove adjacent the radially extending bearing surface, said surface and said groove being complementary disposed with respect to the corresponding portions of said journal;

a plurality of ball bearings disposed intermediate the ball bearing grooves; and a plurality of roller bearings radially disposed intermediate the radial bearing surfaces on said journal and in said cutter.

2. The apparatus of claim 1 and an axially extending roller bearing receiving groove is disposed in the portion of the journal of reduced diameter and a complementary disposed axially extending roller bearing surface in the recess in the cutter and a plurality of roller bearings are disposed therebetween.

3. The apparatus of claim 2 in which the roller bearings disposed in the radial bearing surfaces are of lesser diameter than the others of the roller bearings.

4. The apparatus of claim 1 in which the length of the roller bearings is less than the radial extent of the radial bearing surface on the cutter.

5. In a sealed rotary drilling bit of the class having a plurality of journals, each carrying a rotatable cutter, the combination comprising;

journal means including a radially outwardly opening seal receiving groove having axially displaced inner and outer ends and disposed in proximity to the outer end thereof;

cutter means having a recess complementary in shape to said journal means and rotatably disposed thereon, said cutter means having a radially inwardly facing seal surface at its outer end and complementary disposed and facing said seal receiving groove;

seal means disposed in said seal receiving groove, said seal means exhibiting resilient characteristics and being dimensioned with respect to said seal receiving groove so as to be non-rotatably retained in said groove when the interior of said cutter means is filled with lubricant fluid under pressure and to slideably, sealably engage the seal surface in the recess in said cutters means; and a pressure relief duct extending between the inner and outer ends of said seal receiving groove.

6. The apparatus of claim 5 in which the journal means include the further seal receiving groove axially adjacent the outer end of the seal receiving groove and a hard seal means disposed on the inwardly facing seal surface of the cutter means, for rotation therewith, and extends into said further seal receiving groove.

* * * * *